US011649519B2

(12) United States Patent
Koh et al.

(10) Patent No.: US 11,649,519 B2
(45) **Date of Patent: *May 16, 2023**

(54) SOUR-RESISTANT HEAVY-WALL STEEL PLATE HAVING EXCELLENT LOW-TEMPERATURE TOUGHNESS AND POST-HEAT TREATMENT CHARACTERISTICS AND METHOD FOR MANUFACTURING SAME

(71) Applicant: POSCO CO., LTD, Pohang-si (KR)

(72) Inventors: Seong-Ung Koh, Pohang-si (KR); Jae-Hyun Park, Pohang-si (KR); Moo-Jong Bae, Pohang-si (KR)

(73) Assignee: POSCO Co., Ltd, Pohang-si (KR)

( * ) Notice: Subject to any disclaimer, the term of this patent is extended or adjusted under 35 U.S.C. 154(b) by 216 days.

This patent is subject to a terminal disclaimer.

(21) Appl. No.: 16/471,257

(22) PCT Filed: Nov. 24, 2017

(86) PCT No.: PCT/KR2017/013553

§ 371 (c)(1),
(2) Date: Jun. 19, 2019

(87) PCT Pub. No.: WO2018/117450

PCT Pub. Date: Jun. 28, 2018

(65) Prior Publication Data

US 2020/0239977 A1 Jul. 30, 2020

(30) Foreign Application Priority Data

Dec. 22, 2016 (KR) ..... 10-2016-0177151

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C22C 38/58; C22C 38/00; C22C 38/001; C22C 38/002; C22C 38/02; C22C 38/06;
(Continued)

(56) References Cited

U.S. PATENT DOCUMENTS

2014/0137992 A1* 5/2014 Ishiguro ..... C22C 38/50 148/570
2014/0318672 A1* 10/2014 Yokoi ..... C22C 38/48 148/504
(Continued)

FOREIGN PATENT DOCUMENTS

CN 101845596 A * 9/2010
CN 102277540 A 12/2011
(Continued)

OTHER PUBLICATIONS

American Petroleum Institute, API 5L: Specification for Line Pipe, 2004, American Petroleum Institute, p. 1-155 (Year: 2004).*
(Continued)

*Primary Examiner* — Jie Yang
(74) *Attorney, Agent, or Firm* — Morgan, Lewis & Bockius LLP

(57) ABSTRACT

Provided are: a SOUR-resistant heavy-wall steel plate having excellent low-temperature toughness and post-heat treatment characteristics; and a method for manufacturing the same. The SOUR-resistant heavy-wall steel plate of the present invention comprises: in terms of weight %, 0.02-0.06% of C; 0.5% or less of Si (excluding 0%); 0.8-2.0% of Mn; 0.03% or less of P; 0.003% or less of S; 0.06% or less
(Continued)

of Al; 0.01% or less of N; 0.005-0.1% of Nb; 0.005-0.05% of Ti; 0.0005-0.005% of Ca; one or more selected from 0.05-0.5% of Ni, 0.05-0.5% of Cr, 0.02-0.4% of Mo, and 0.005-0.1% of V; and the remainder Fe and unavoidable impurities, wherein the heavy-wall steel plate satisfies relational expressions 1-3, and has a percent ductile fracture of 85% or more in the drop weight tear test (DWTT) at −20° C.

7 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C21D 2211/005* (2013.01)

(58) Field of Classification Search
CPC ..... C22C 38/12; C22C 38/14; C22C 38/42; C22C 38/44; C22C 38/46; C22C 38/48; C22C 38/50; B21B 3/00; C21D 6/00; C21D 6/004; C21D 6/005; C21D 6/008; C21D 8/0205; C21D 8/0226; C21D 8/0263; C21D 2211/002; C21D 2211/004; C21D 2211/005; C21D 2211/008
See application file for complete search history.

(56) References Cited

U.S. PATENT DOCUMENTS

| | | | | |
|---|---|---|---|---|
| 2015/0090370 | A1* | 4/2015 | Shimamura | C22C 38/50 148/521 |
| 2015/0176110 | A1* | 6/2015 | Kami | C21D 9/085 148/504 |
| 2015/0203945 | A1* | 7/2015 | Ichimiya | C21D 6/001 148/645 |
| 2016/0017466 | A1* | 1/2016 | Shibata | C21D 6/001 148/645 |
| 2016/0312327 | A1 | 10/2016 | Ichimiya et al. | |
| 2017/0342518 | A1* | 11/2017 | Lee | C21D 8/0205 |
| 2018/0073094 | A1* | 3/2018 | Bai | C21D 8/105 |
| 2019/0093204 | A1* | 3/2019 | Lee | C22C 38/14 |
| 2019/0211430 | A1* | 7/2019 | Goto | C21D 6/002 |

FOREIGN PATENT DOCUMENTS

| | | | |
|---|---|---|---|
| CN | 102301026 | A | 12/2011 |
| CN | 102653844 | A | 9/2012 |
| CN | 102112643 | A | 11/2013 |
| CN | 104789863 | A | 7/2015 |
| CN | 104789866 | A | 7/2015 |
| CN | 105980588 | A | 9/2016 |
| CN | 108603266 | A | 9/2018 |
| EP | 2309014 | A1 | 4/2011 |
| EP | 2392682 | A1 | 12/2011 |
| EP | 3409804 | A1 | 12/2018 |
| JP | S58-100624 | A | 6/1983 |
| JP | H07-286214 | A | 10/1995 |
| JP | H08-199293 | A | 8/1996 |
| JP | H09-296248 | A | 11/1997 |
| JP | 2010-037567 | A | 2/2010 |
| JP | 2010-189722 | A | 9/2010 |
| JP | 2010-196164 | A | 9/2010 |
| KR | 10-0660230 | B1 | 12/2006 |
| KR | 10-0833069 | B1 | 5/2008 |
| KR | 10-2012-011292 | A | 2/2012 |
| KR | 10-2012-0071619 | A | 7/2012 |
| KR | 20140055460 | A * | 5/2014 |
| KR | 10-2014-0083538 | A | 7/2014 |
| KR | 10-2015-0073024 | A | 6/2015 |
| KR | 10-2016-0077392 | A | 7/2016 |
| KR | 10-2016-0078624 | A | 7/2016 |
| KR | 10-1639902 | B1 | 7/2016 |
| KR | 10-1657823 | B1 | 9/2016 |
| WO | 2017/130885 | A1 | 8/2017 |

OTHER PUBLICATIONS

NPL: on-line translation of CN-101845596-A, Sep. 2010 (Year: 2010).*
International Search Report dated Mar. 16, 2018 issued in corresponding International Patent Application No. PCT/KR2017/013553.
Extended European Search Report dated Oct. 17, 2019 issued in European Patent Application No. 17884620.0.
Chinese Office Action dated Jul. 27, 2020 issued in Chinese Patent Application No. 201780079347.1 (with English translation).
Japanese Office Action dated Sep. 1, 2020 issued in Japanese Patent Application No. 2019-532675.

* cited by examiner

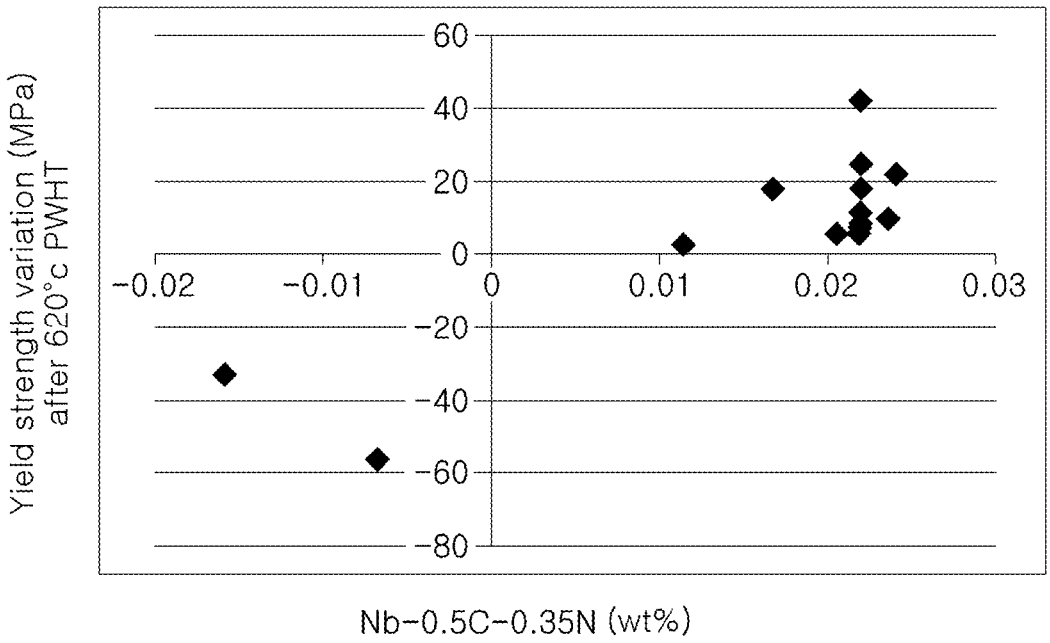
Yield strength variation (MPa) after 620°c PWHT
60
40
20
0
-20
-40
-60
-80
-0.02
-0.01
0
0.01
0.02
0.03
Nb-0.5C-0.35N (wt%)

SOUR-RESISTANT HEAVY-WALL STEEL PLATE HAVING EXCELLENT LOW-TEMPERATURE TOUGHNESS AND POST-HEAT TREATMENT CHARACTERISTICS AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/013553, filed on Nov. 24, 2017, which in turn claims the benefit of Korean Patent Application No. 10-2016-0177151, filed Dec. 22, 2016, the entire disclosures of which applications are incorporated by reference herein.

TECHNICAL FIELD

The present disclosure relates to a SOUR-resistant thick and wide heavy-wall steel plate having excellent low-temperature toughness and post-heat treatment characteristics and method of manufacturing the same. More specifically, the present disclosure is directed to a SOUR-resistant thick steel plate, having excellent SOUR-resistant characteristics and low-temperature toughness, in which a reduction in yield strength does not occur even after a post weld heat treatment and a method of manufacturing the same.

BACKGROUND ART

Recently, as the development of oilfields has been centered on extreme regions in which weather conditions are poor, projects have been actively undertaken to transport rich gas resources in oilfields to consumption areas through line pipes. Such line pipe projects require a high-strength thick material in consideration of an extremely low temperature and a high gas transportation pressure. When a large-diameter steel pipe is applied in consideration of transportation efficiency, there is need for a wide thick plate material having a width of 3,500 mm or more. In order to be applied to extreme cold regions, excellent low temperature toughness is required and a SOUR-resistant thick steel plate is required in consideration of hydrogen-induced cracking caused by a hydrogen sulfide in crude oil or natural gas. In some cases, guarantee of physical properties following PWHT is required to release a residual stress in a pipe or a welded portion. Conventionally, there is a demand for steel having a small strength decrease following PWHT at a temperature of about 620° C.

Low-temperature toughness in a line pipe steel plate is evaluated by a drop weight tear tester (DWTT) test. A steel plate, having a DWTT percent ductile fracture of 85% or higher at a temperature of −10° C., was available in a conventional environment. However, a steel plate, satisfying a DWTT percent ductile fracture of 85% or higher even at a temperature of −20° C. or less, is required in a cold climate environment such as Siberia and Alaska. In general, steel for a line pipe, having excellent low-temperature fracture toughness, is manufactured by a thermo-mechanical control process (TMCP) method in which accelerated cooling is performed after rough rolling in a recrystallization region and finishing rolling in a non-recrystallization region are sequentially performed. In a steel plate produced by the ordinary TMCP process, a thickness center portion has a relatively coarser grain size number than a surface. A large number of coarse hard phases are distributed in a central segregation portion. Therefore, grain refinement and hard phase control in a central portion are core technologies to secure low-temperature toughness. When a product increases in thickness, it is difficult to add sufficient deformation to a central portion through rolling. Therefore, it may be difficult to achieve grain refinement in the central portion and coarse crystal grains are liable to forma hard phase during a cooling process. In addition, when the steel plate increases in width, it becomes difficult to sufficiently add deformation due to a limitation in a load per unit path which can be added to a steel plate by a rolling mill. As a result, crystal grains become coarser than in a narrow steel plate and low-temperature toughness of the steel sheet is deteriorated.

A composition was optimized to secure fracture propagation resistance in a central portion, and austenite crystal growth was inhibited by low-temperature heating of a slab. At the same time, crystal grains of an ultimate microstructure are refined through low-temperature non-recrystallization zone rolling. Such a technology has been applied to secure low-temperature toughness of a line pipe steel plate. However, in the case of a high-strength thick steel plate having a thickness of 30 mm or more, a related-art technology has a limitation in securing DWTT characteristics at a guaranteed temperature of −20° C.

In addition, a PWHT process is applied to release residual stress in a pipe and a welded portion. When PWHT is applied, strength is reduced. Accordingly, a steel plate, having strength higher than required strength of a pipe, may be used in consideration of an amount of strength reduction, which causes various issues depending on the increase in strength.

DISCLOSURE

Technical Problem

An aspect of the present disclosure is to provide a high-strength thick and wide heavy-wall SOUR-resistant TMCP steel plate, having excellent low-temperature toughness and having a thickness of 300 mm or more and a width of 3,500 mm or more, in which a decrease in strength does not occur even after PWHT, and a method of manufacturing the SOUR-resistant TMCP steel plate.

The object of the present disclosure is not limited to the above description. Those skilled in the art will appreciate that there will be no difficulty in understanding the present disclosure from the overall contents of the present disclosure.

Technical Solution

An aspect of the present disclosure relates to a heavy-wall steel plate of a yield strength grade of 500 MPa, having excellent low-temperature toughness and hydrogen-induced cracking resistance and having a thickness of 30 mm or more and a width of 3,500 mm or more, and a method of manufacturing the thick steel plate. According to the thick steel plate, low-temperature DWTT characteristics and hydrogen-induced cracking resistance are excellent and yield strength is not reduced even after PWHT.

According to an aspect of the present disclosure, a SOUR-resistant heavy-wall steel plate, having excellent low-temperature toughness and post-heat treatment characteristics, includes: in terms of weight %, 0.02-0.06% of C; 0.5% or less of Si (excluding 0%); 0.8-2.0% of Mn; 0.03% or less of P; 0.003% or less of S; 0.06% or less of Al; 0.01% or less of N; 0.005-0.1% of Nb; 0.005-0.05% of Ti; 0.0005-0.005% of Ca; one or more selected from 0.05-0.5% of Ni, 0.05-0.5% of Cr, 0.02-0.4% of Mo, and 0.005-0.1% of V; and the remainder Fe and unavoidable impurities.

The heavy-wall steel plate satisfies relational expressions 1-3, and has a percent ductile fracture of 85% or more in the drop weight tear test (DWTT) at −20° C., Ca/S: 0.5~5.0 [Relation Expression 1]

Ni+Cr+Mo+V≤0.8% [Relational Expression 2]

Nb−0.5*C+0.35*N>0% [Relational Expression 3]

where Ca, S, Ni, Cr, Mo, V, Nb, C, and N represent contents of respective elements by wt %.

The heavy-wall steel plate may have a thickness of 30 mm or more, a width of 3500 mm or more, and yield strength of 500 MPa or more.

The heavy-wall steel plate may have acicular ferrite or a complex structure of acicular ferrite and polygonal ferrite as a microstructure, and a fraction of the upper bainite within 10 mm of upper and lower portions on the basis of a thickness central portion may be 5 area % or less.

The yield strength of the heavy-wall steel plate may not be decreased even after PWHT.

According to another aspect of the present disclosure, a method of manufacturing a SOUR-resistant heavy-wall steel plate, having low-temperature toughness and hot-heat treatment characteristics, includes rolling a steel slab including, in terms of weight %, 0.02-0.06% of C; 0.5% or less of Si (excluding 0%); 0.8-2.0% of Mn; 0.03% or less of P; 0.003% or less of S; 0.06% or less of Al; 0.01% or less of N; 0.005-0.1% of Nb; 0.005-0.05% of Ti; 0.0005-0.005% of Ca; one or more selected from 0.05-0.5% of Ni, 0.05-0.5% of Cr, 0.02-0.4% of Mo, and 0.005-0.1% of V; and the remainder Fe and unavoidable impurities, and satisfying relational expressions 1-3, after reheating the steel slab at a temperature in the range of 1100~1300° C.; controlling maintaining time, until start of finish rolling after water-cooling the rough-rolled steel slab, to be 300 seconds or less, and then finish rolling the steel slab at Ar3+200° C. to Ar3+30° C. at a cumulative reduction ratio of 50% or more; and starting to cool the finish rolled steel slab at Ar3+100° C. to Ar3 at a cooling rate of 15° C./sec and ending the cooling at 500° C. or less, Ca/S: 0.5~5.0 [Relation Expression 1]

Ni+Cr+Mo+V≤0.8% [Relational Expression 3]

Nb−0.5*C+0.35*N>0% [Relational Expression 3]

where Ca, S, Ni, Cr, Mo, V, Nb, C, and N represent contents of respective elements by wt %.

According to another aspect of the present disclosure, a method of manufacturing a SOUR-resistant heavy-wall steel plate, having low-temperature toughness and hot-heat treatment characteristics, includes rolling a steel slab including, in terms of weight %, 0.02-0.06% of C; 0.5% or less of Si (excluding 0%); 0.8-2.0% of Mn; 0.03% or less of P; 0.003% or less of S; 0.06% or less of Al; 0.01% or less of N; 0.005-0.1% of Nb; 0.005-0.05% of Ti; 0.0005-0.005% of Ca; one or more selected from 0.05-0.5% of Ni, 0.05-0.5% of Cr, 0.02-0.4% of Mo, and 0.005-0.1% of V; and the remainder Fe and unavoidable impurities, and satisfying relational expressions 1-3, after reheating the steel slab at a temperature in the range of 1100-1300° C.; controlling maintaining time, until start of finish rolling after water-cooling the rough-rolled steel slab, to be 300 seconds or less, and then finish rolling the steel slab at Ar3+200° C. to Ar3+30° C. at a cumulative reduction ratio of 50% or more; and starting to cool the finish rolled steel slab at Ar3+100° C. to Ar3 at a cooling rate of 15° C./sec and ending the cooling at 500° C. or less, Ca/S: 0.5~5.0 [Relation Expression 1]

Ni+Cr+Mo+V≤0.8% [Relational Expression 2]

Nb−0.5*C+0.35*N>0% [Relational Expression 3]

where Ca, S, Ni, Cr, Mo, V, Nb, C, and N represent contents of respective elements by wt %.

The method further includes performing a PWHT heat treatment on the heavy-wall steel plate obtained by ending the cooling.

Advantageous Effects

As set forth above, according to an example embodiment in the present disclosure, a high-strength thick and wide heavy-wall SOUR-resistant TMCP steel plate, having excellent low-temperature toughness and having a thickness of 300 mm or more and a width of 3,500 mm or more, in which a decrease in strength does not occur even after PWHT, may be provided.

DESCRIPTION OF DRAWINGS

FIG. 1 is a graph illustrating a variation in yield strength depending on Nb−0.5*C+0.35*N (weight %) after 620° C. PWHT.

BEST MODE FOR INVENTION

The present inventors have repeatedly conducted research and experimentations to improve DWTT characteristics of a thick and wide steel plate. The present inventors found a technology to secure DWTT characteristics. Unlike a manufacturing method according to a related art, in the found technology, water cooling is performed before finish rolling after rough rolling. Thus, austenite crystal growth is inhibited to secure the DWTT characteristics. The found technology was based on the fact that when Nb, dissolved in steel, is precipitated during a PWHT heat treatment, strength may be increased due to precipitation strengthening to compensate for strength decrease resulting from a post-heat treatment. Accordingly, the present inventor found that when an appropriate steel composition and an appropriate control technology are provided, a burden of securing additional strength of a steel material considering PWHT may be removed.

Hereinafter, the present disclosure will be described in detail.

Compositional components and reasons for limiting components of a thick and wide heavy-wall steel plate, having excellent low-temperature DWTT characteristics and excellent hydrogen-induced fracture resistance, in which a decrease in strength does not occur even after PWHT, will be described. Throughout the present specification, "%" refers to "weight % (wt %)" unless otherwise specified.

C: 0.02 to 0.06%

C is closely related to the manufacturing method together with other components. Among the steel components, C has a greatest influence on the characteristics of the steel material. When the content of C is less than 0.02 wt %, component control costs during a steel manufacturing process are excessively incurred, and a welding heat-affected zone is softened more than necessary. Meanwhile, when the content of C is more than 0.06 wt %, low-temperature DWTT characteristics and hydrogen-induced resistance of the steel plate are decreased, weldability is deteriorated, and most added Nb is precipitated during a rolling process to decrease a precipitated amount upon cooling. Therefore, the content of C is limited to a range from 0.02 to 0.08 wt %.

Si: 0.5% or Less (Excluding 0%)

Si not only acts as a deoxidizer in a steel manufacturing process, but also serves to improve the strength of the steel material. When the content of Si is more than 0.5 wt %, the low-temperature DWTT characteristic of the material is deteriorated, weldability is lowered, and scale peelability is caused upon rolling. Therefore, the content of Si is limited to, in detail, 0.5 wt % or less. Since similar effects may be achieved by other elements even if the content of Si is slightly low, a lower limit of the content of Si is not limited. In consideration of the above-mentioned roles of Si and the fact that manufacturing costs may be increased when the content of Si is excessively decreased, the content of Si may be limited to 0.1 wt % or more.

Mn: 0.8 to 2.0%

Mn is an element which does not inhibit low-temperature toughness while improving quenching property. In detail, 0.8 wt % or more of Mn is added. However, when added in an amount more than 2.0 wt %, center segregation occurs to not only decrease low-temperature toughness, but also to raise the hardening property of steel and decrease weldability. In detail, the content of Mn is limited to a range from 0.8 to 2.0 wt %. In further detail, the content of Mn is 0.8 to 1.6 wt % to further limit the center segregation.

P: 0.03% or Less

P is an impurity element. When the content o P is greater than 0.03 wt %, weldability is significantly decreased, and also low-temperature toughness is decreased. Therefore, the content of P is limited to, in detail, 0.03 wt % or less. In further detail, the cement of P is 0.01 wt % or less to secure the low-temperature toughness.

S: 0.003% or Less

S is also an impurity element. When the content of S is greater than 0.003 wt %, the ductility, low-temperature toughness, and weldability of steel are decreased. Therefore, the content of S is limited to, in detail, 0.003 wt % or less. Since S is bonded to Mn to form a MnS inclusion and to decrease the hydrogen-induced cracking resistance of steel, the content of S is, in further detail, 0.002 wt % or less.

Al: 0.06% or Less

Usually, Al serves as a deoxidizer which reacts with oxygen present in molten steel to remove oxygen. Therefore, it is general to add Al in an amount to provide a steel material with sufficient deoxidation ability. However, when more than 0.06 wt % of Al is added, a large amount of an oxide-based inclusion is formed to inhibit the low-temperature toughness and hydrogen-induced cracking resistance of a material. Therefore, the content of Al is limited to 0.06 wt % or less.

N: 0.01% or Less

In the present disclosure, N is present as an impurity element. Since it is difficult to industrially completely remove N from steel, the upper limit thereof is 0.01 wt % allowable in a manufacturing process. N forms nitrides with Al, Ti, Nb, V, and the like, to inhibit austenite crystal grain growth and to help toughness and strength improvement. However, when the content of N is excessive and greater than 0.01 wt %, N is present in a solid-solubilized state. N in the solid-solubilized state has an adverse influence on low-temperature toughness. Accordingly, the content of N is limited to, in detail, 0.01 wt % or less.

Nb: 0.005 to 0.1%

Nb is solid-solubilized when reheating a slab, and inhibits austenite crystal grain growth during hot rolling, and then is precipitated to improve the strength of steel. When a post-heat treatment is performed, Nb is bonded to carbon to form a low-temperature precipitate phase, and serves to compensate for the strength decrease when the post-heat treatment is performed. However, when Nb is added in an amount less than 0.005 wt %, it is difficult to secure the precipitated amount of the Nb-based precipitate sufficient to compensate for the strength decrease when the post-heat treatment is performed, and growth of austenite crystal grains occurs during a rolling process to decrease low-temperature toughness. Meanwhile, when Nb is excessively added in an amount more than 0.1 wt %, austenite crystal grains are refined more than necessary to cause low-temperature toughness and hydrogen-induced cracking resistance to be reduced by a coarse precipitate. Therefore, the content of Nb is limited to 0.1 wt % or less. In terms of low-temperature toughness, the content of Nb added is, in further detail, 0.05 wt % or less.

Ti: 0.005 to 0.05%

Ti is an element effective in inhibiting the growth of austenite crystal grains by bonding to N, when a slab is reheated, to form TiN. However, when Ti is added in an amount less than 0.005 wt %, the austenite crystal grains become coarse to decrease low-temperature toughness. When Ti is added in an amount more than 0.05 wt %, a coarse Ti-based precipitate is formed to decrease low-temperature toughness and hydrogen-induced cracking resistance. Accordingly, the content of Ti is limited to 0.005 to 0.05 wt %. In terms of low-temperature toughness, in further detail, 0.03 wt % or less of Ti is added.

Ca: 0.0005 to 0.005%

Ca serves to spheroidize a MnS inclusion. MnS, an inclusion having a low melting point, is stretched during rolling to serve as a starting point of hydrogen-induced cracking. The added Ca reacts with MnS to surround MnS, thereby interfering with the stretching of MnS. When the content of Ca is 0.0005 wt % or less, such an effect may not be achieved. Since a large amount of oxide-based inclusion, which may be a starting point of hydrogen-induced cracking, is produced when a large amount of Ca is added, an upper limit of the content of Ca is 0.005 wt %.

In the present disclosure, a content ratio Ca/S, defined by Relational Expression 1, is controlled to be, in detail, 0.5 to 5.0. When the radio Ca/S is an index representing MnS center segregation and formation of a coarse inclusion and is less than 0.5, MnS is formed in the center of the steel plate to reduce the hydrogen-induced cracking resistance. Meanwhile, when the ratio Ca/S is greater than 5.0, a Ca-based coarse inclusion may be formed to lower the hydrogen-induced cracking resistance.

$$Ca/S: 0.5 \text{ to } 5.0 \qquad \text{(Relational Expression 1)}$$

In addition to the above-mentioned composition, the steel plate of the present disclosure may further include one or two more selected from the elements, Ni, Cr, Mo, and V.

Ni: 0.05 to 0.5%

Ni is an element, improving toughness of steel, and is added to increase strength of the steel without deterioration in low-temperature toughness. When Ni is added in amount less than 0.05 wt %, strength increase, caused by addition of Ni, may be not achieved. When Ni is added in amount greater than 0.5 wt %, high costs may be incurred due to addition of Ni. Therefore, the content of Ni is limited to a range from 0.05 to 0.5 wt %.

Cr: 0.05 to 0.5%

Cr is solid-solubilized in austenite when a slab is reheated, thereby serving to increase quenching property of a steel material. However, when Cr is added in an amount greater than 0.5 wt %, weldability is decreased. Therefore, the content of Cr is limited to a range from 0.05 to 0.5 wt %.

Mo: 0.02 to 0.4%

Mo is an element similar to or has more aggressive effects than Cr, and serves to increase quenching property of a steel material and to prevent a strength decrease of a heat treatment material. When Mo is added in an amount less than 0.02 wt %, it is difficult to secure the quenching property of steel, and also a strength decrease after heat treatment is excessive. Meanwhile, when Mo is added in an amount greater than 0.4 wt %, a structure having vulnerable low-temperature toughness is formed, weldability is decreased, and temper embrittlement is caused. Therefore, the content of Mo is limited to, in detail, a range from 0.02 to 0.4 wt %.

V: 0.005 to 0.1%

V increases the quenching property of steel to increase strength, but is partially precipitated during a post-heat treatment to additionally complement precipitation of Nb and to prevent strength decrease. However, when V is added in an amount less than 0.005 wt %, there is no effect to prevent strength decrease of a heat treatment material. When V is added in an amount greater than 0.1 wt %, low-temperature phases are formed due to an increase in quenching property of steel to decrease low-temperature toughness and hydrogen-induced cracking resistance. Therefore, the content of V is limited to a range from 0.005 to 0.1 wt %. In terms of low-temperature toughness, the content of V is, in further detail, 0.05 wt % or less.

Sum of Ni, Cr, Mo, and V: 0.8% or Less

In the present disclosure, the sum of Ni+Cr+Mo+V, defined by Relational Expression 2, is controlled to be 0.8 wt % or less. Ni, Cr, Mo, and V are elements which increase a carbon equivalent of steel, except for C and Mn which have a dominant effect on low-temperature DWTT characteristics and hydrogen-induced cracking characteristics of the steel. When the sum of the contents thereof is greater than 0.8 wt %, strength of the steel is increased more than necessary. Thus, low-temperature DWTT characteristics and the hydrogen-induced cracking resistance may be reduced, and the manufacturing costs may be excessively increased.

$$Ni+Cr+Mo+V \leq 0.8\% \quad \text{(Relational Expression 2)}$$

In the present disclosure, in detail, the contents of Nb, C, and N satisfy Relational Expression 3. In the present disclosure, Nb needs to be precipitated during a post-heat treatment to forma precipitate. However, when the contents of Nb, C and N do not satisfy Relational Expression 3, most of Nb is precipitated during heating, rolling, and cooling. Accordingly, there may be no effect in which Nb is precipitated during the post-heat treatment to prevent strength decrease.

$$Nb-0.5*C+0.35*N>0\% \quad \text{(Relational Expression 3)}$$

A thick and wide heavy-wall steel plate of a yield strength grade of 500 MPa, having excellent low-temperature DWTT characteristics and hydrogen-induced cracking resistance, may have an acicular ferrite structure or a complex structure of acicular ferrite and polygonal ferrite. For example, a heavy-wall steel plate, having excellent low-temperature DWTT characteristics and hydrogen-induced cracking resistance of the present disclosure, is maintained at high strength of 500 MPa or more in yield strength and has excellent low-temperature DWTT characteristics and hydrogen-induced cracking resistance even the steel plate has a thickness greater than 30 mm. In detail, the heavy-wall steel plate has a single phase structure of acicular ferrite or a complex structure of acicular ferrite and polygonal ferrite. In addition, since formation of upper bainite, deteriorating DWTT characteristics in a thickness central portion, is inhibited to secure low-temperature DWTT characteristics, a fraction of the upper bainite within 10 mm of upper and lower portions on the basis of the thickness central portion is limited to, in detail, 5 area % or less.

A steel plate of the present disclosure, having an advantageous composition and a steel microstructure described above, may be easily manufactured by a person ordinary skilled in the art without excessively repeated experiments. However, the present disclosure proposes an advantageous manufacturing method found by the present inventors as a few examples.

In the present disclosure, a steel slab, having the same composition as described above, is reheated in a temperature range of 1100 to 1300° C. and is then subjected to rough rolling.

In an example embodiment, the reheating temperature of the slab is limited to, in detail, a range from 1100 to 1300° C. When the reheating temperature is higher that 1300° C., an upper limit proposed in the present disclosure, the austenite grains become coarse to deteriorate the low-temperature DWTT characteristics. When the reheating temperature is lower than 1100° C., an alloying element solid-solubility may be decreased. Therefore, in the present disclosure, the reheating temperature is limited to, in detail, a range from 1100 to 1300° C. In terms of the low-temperature toughness, the reheating temperature is limited to, further detail, a range from 1100 to 1200° C.

In the present disclosure, a maintaining time until start of finish rolling of the steel slab after cooling the rough-rolled steel slab is controlled to be 300 seconds or less.

In an example embodiment, the maintaining time until the start of the finish rolling after the rough rolling is limited to 300 seconds or less to secure the DWTT characteristics. This is because it is difficult to secure low-temperature DWTT characteristics of a high-strength thick and wide material even using a conventional method of heating-rough rolling-air cooling standing-finish rolling. More specifically, this is because when a steel plate is maintained at a high temperature, the steel plate may be grown and coarsened by rough rolling to deteriorate low temperature toughness of the steel plate. Accordingly, in an example embodiment, in detail, a bar is forcibly water-cooled after typical rough rolling and is then cooled to a starting temperature of finish rolling within 300 seconds to inhibit austenite grain growth before the finish rolling. When the maintaining time until the finish rolling after the rough rolling is greater than 300 seconds, the low temperature DWTT characteristics of the steel plate may not be ensured due to the austenite grain growth before the finish rolling. In terms of the low temperature DWTT characteristics, the maintaining time is controlled to 100 seconds or less.

In the present disclosure, finish rolling is performed at a temperature of Ar3+200° C. to Ar3+30° C. at a cumulative reduction ratio of 50% or more. The finish rolling temperature is limited to a range from Ar3+200° C. to Ar3+30° C. to prevent formation of superfine ferrite while inhibiting grain growth and precipitate growth as much as possible. When the finish rolling temperature is higher than Ar3+200° C., crystal grains and Nb precipitates are grown to deteriorate low-temperature DWTT characteristics. When the finish temperature is lower than Ar3+30° C., the cooling start temperature is decreased below Ar3. Since superfine ferrite is formed before start of cooling due to cooling start of a two-phase region, strength of steel may be decreased.

In this case, the finish rolling is performed in such a manner that cumulative reduction is 50% or more. Since a target steel plate of the present disclosure is a thick heavy-wall steel plate having a thickness of 30 mm or more, a finish rolling cumulative reduction ratio is limited to 50% or more to transfer sufficient reduction force to a central portion and to refine the crystal grains. When the cumulative rolling reduction ratio is less than 50%, a lower limit proposed in the present disclosure, recrystallization, caused by rolling, does not occur up to the central portion. Therefore, crystal grains in the central portion may become coarse and the low-temperature DWTT characteristic may be deteriorated.

In the present disclosure, the finish rolled steel plate starts to be cooled at a cooling rate of 15° C./sec or more at a temperature of Ar3+100° C. to Ar3. The cooling of the steel plate is ended at a temperature of 500° C. or less.

In the present disclosure, cooling is performed after the finish rolling is performed.

A cooling method of the present disclosure is a water-cooling method in which cooling is started in an austenite single-phase region after finish rolling is ended. A cooling staring temperature is limited to, in detail, a range from Ar3+100° C. to Ar3. When the cooling starting temperature is higher than Ar3+100° C., a finish rolling temperature is increased, which is disadvantageous in terms of low-temperature DWTT of a steel material. When the cooling starting temperature is lower than Ar3, superfine ferrite is formed before cooling. Therefore, strength of steel may not be secured. In addition, since residual austenite is transformed into upper bainite, low-temperature DWTT characteristics and hydrogen-induced cracking resistance may be deteriorated.

In the present disclosure, the cooling is performed at a cooling rate of 15° C./sec or more at the cooling start temperature to 500° C. or less, a cooling end temperature. When the cooling rate or the cooling ending temperature is outside of the range proposed in the present disclosure, cooling is not sufficient. Thus, the microstructure, proposed in the present disclosure, may not be implemented and yield strength of the steel plate may not be secured.

In the present disclosure, a cooling-ended thick plate steel material may be subjected to a PWHT heat treatment.

MODE FOR INVENTION

Hereinafter, the present disclosure will be described in detail through the Examples. However, it should be noted that the following Examples are only for embodying the present disclosure by illustration, and not intended to limit the right scope of the present disclosure. The reason is that the right scope of the present disclosure is determined by the matters described in the claims and reasonably inferred therefrom.

Example

Slabs, having compositions listed in Table 1, were heated, hot-rolled, and acceleratively cooled to manufacture steel plates. In Table 2, inventive examples correspond to compositions and manufacturing conditions of the present disclosure, and comparative examples are outside of any one of the compositions and the production conditions of the present disclosure.

Inventive examples and comparative examples of Table 2 are prepared by the same process except that they follow the compositions of Table 1 and the manufacturing process conditions of Table 2. More specifically, steel plates of the inventive examples and the comparative examples were manufactured by hot-rolling slabs, having the compositions of Table 1, to sizes of Table 2, heating the hot-rolled slabs to heating temperatures of Table 2, rough-rolling the hot-rolled slabs, controlling standby time until start of finish rolling under conditions of Table 2 after performing the rough rolling, and finish rolling the rough-rolled slabs in conditions of Table 2 following by cooling the finish rolled steel plates. The cooling-ended steel plates were subjected to a heat treatment at a PWHT temperature of 620° C.

Microstructures of the above-manufactured steel plates were tested as illustrated in Table 3, and an upper bainite area fraction in a central portion, yield strength variations after PWHT, DWTT percent ductile fractures, crack length ratios (CLR) were measured, and results thereof are listed in Table 3.

An area fraction of the upper bainite was obtained by observing the microstructure of the steel plate within 10 mm above and below based on a thickness central portion, and a DWTT percent ductile fracture was evaluated at a temperature of −20° C. based on the API-5L standard. The listed crack length ratio (CRL) was obtained by calculating percentage of a hydrogen-induced cracking length generated for overall length of a sample after being tested in accordance with a method specified by National Association of Corrosion Engineers (NACE).

Values, listed in Table 1, refer to weight % (wt %). Comparative Examples 1 to 5 are examples in which steel composition components are outside of a scope of the present disclosure. Comparative Examples 6 to 11 are examples in which steel composition components satisfy the range of the present disclosure, but manufacturing process conditions are outside of the scope of the present disclosure.

TABLE 1

| Steel Type No. | C | Si | Mn | P | S | Al | N | Ni | Cr | Mo | Nb | Ti | V | Ca | A* | D* | E* |
|---|---|---|---|---|---|---|---|---|---|---|---|---|---|---|---|---|---|
| 1 | 0.04 | 0.24 | 1.41 | 0.006 | 0.0007 | 0.024 | 0.003 | 0.34 | 0.25 | 0.15 | 0.043 | 0.012 | 0.027 | 0.0018 | 0.767 | 2.6 | 0.02 |
| 2 | 0.038 | 0.25 | 1.43 | 0.006 | 0.0009 | 0.023 | 0.004 | 0.32 | 0.27 | 0.14 | 0.041 | 0.013 | 0.022 | 0.0016 | 0.752 | 1.8 | 0.02 |
| 3 | 0.042 | 0.23 | 1.42 | 0.009 | 0.0008 | 0.025 | 0.004 | 0.33 | 0.28 | 0.13 | 0.046 | 0.011 | 0.025 | 0.0011 | 0.765 | 1.4 | 0.02 |
| 4 | 0.11 | 0.25 | 1.44 | 0.008 | 0.0008 | 0.031 | 0.005 | 0.21 | 0.25 | 0.13 | 0.05 | 0.011 | 0.02 | 0.0015 | 0.61 | 1.9 | −0.01 |
| 5 | 0.043 | 0.24 | 2.11 | 0.008 | 0.0008 | 0.029 | 0.006 | — | 0.1 | 0.12 | 0.035 | 0.006 | 0.13 | 0.0011 | 0.35 | 1.4 | 0.01 |
| 6 | 0.037 | 0.22 | 1.22 | 0.06 | 0.001 | 0.038 | 0.004 | 0.16 | 0.22 | 0.1 | 0.044 | 0.013 | 0.23 | 0.0004 | 0.71 | 0.4 | 0.02 |
| 7 | 0.039 | 0.25 | 1.31 | 0.008 | 0.0008 | 0.026 | 0.005 | 0.12 | 0.19 | 0.33 | 0.038 | 0.011 | 0.25 | 0.0018 | 0.89 | 2.3 | 0.02 |
| 8 | 0.044 | 0.23 | 1.45 | 0.008 | 0.0009 | 0.025 | 0.005 | 0.35 | 0.11 | 0.19 | 0.008 | 0.012 | 0.022 | 0.0016 | 0.672 | 1.8 | −0.02 |

*denotes remainder Fe and unavoidable impurities in Table 1

A* denotes Ni + Cr + Mo + V, D* denotes a Ca/S ratio, and E* denotes Nb − 0.5*C + 0.35*N.

TABLE 2

| Steel Type No. | Thickness (mm) | Width (mm) | Reheating Temperature (° C.) | Standby Time (second) | Finish Rolling Starting Temperature (° C.) | Finish Rolling Ending Temperature (° C.) | Finish Rolling Cumulative Reduction Ratio (%) | Cooling Starting Temperature (° C.) | Cooling Ending Temperature (° C.) | Cooling Rate (° C./S) | Note |
|---|---|---|---|---|---|---|---|---|---|---|---|
| 1 | 30.9 | 3715 | 1128 | 83 | 870 | 822 | 80 | 798 | 458 | 37 | IE1 |
| 2 | 34.6 | 3740 | 1119 | 92 | 859 | 828 | 77 | 805 | 488 | 29 | IE2 |
| 3 | 45 | 3741 | 1125 | 98 | 857 | 830 | 77 | 809 | 470 | 26 | IE3 |
| 4 | 38.3 | 3800 | 1129 | 96 | 891 | 799 | 75 | 776 | 485 | 24 | CE1 |
| 5 | 42 | 3840 | 1127 | 88 | 888 | 786 | 75 | 764 | 444 | 24 | CE2 |
| 6 | 34.7 | 3558 | 1133 | 254 | 865 | 828 | 77 | 790 | 451 | 29 | CE3 |
| 7 | 43 | 3748 | 1121 | 97 | 855 | 808 | 77 | 787 | 466 | 24 | CE4 |
| 8 | 39.5 | 3567 | 1129 | 86 | 890 | 843 | 78 | 812 | 456 | 27 | CE5 |
| 1 | 30.9 | 3715 | 1131 | 324 | 876 | 826 | 80 | 802 | 465 | 38 | CE6 |
| | 30.9 | 3715 | 1132 | 95 | 973 | 895 | 77 | 871 | 439 | 40 | CE7 |
| | 30.9 | 3715 | 1145 | 79 | 845 | 823 | 40 | 800 | 453 | 37 | CE8 |
| | 30.9 | 3715 | 1127 | 85 | 785 | 765 | 77 | 722 | 432 | 24 | CE9 |
| | 30.9 | 3715 | 1133 | 88 | 839 | 833 | 80 | 804 | 545 | 21 | CE10 |
| | 30.9 | 3715 | 1121 | 98 | 856 | 807 | 80 | 799 | 497 | 8 | CE11 |

IE: Inventive Example
CE: Comparative Example
* Ar3 = 910 − 310*C − 80*Mn − 20*Cu − 15*Cr − 55*N − 80*Mo + 0.35*(thickness − 8)

TABLE 3

| Steel Type No. | Matrix Structure | Center UB Fraction (area %) | Yield Strength before PWHT (MPa) | Yield Strength after PWHT (MPa) | Yield Strength Variation (MPa) | DWTT Percent Ductile Fracture (−20° C.) | Hydrogen-Induced Cracking | Note |
|---|---|---|---|---|---|---|---|---|
| 1 | AF + PF | 1.2 | 536 | 543 | 7 | 96 | Not Occur | IS1 |
| 2 | AF | 0.3 | 539 | 545 | 6 | 100 | Not Occur | IS2 |
| 3 | AF + PF | 0.4 | 529 | 539 | 10 | 99 | Not Occur | IS3 |
| 4 | AF + UB | 38.4 | 577 | 521 | −56 | 22 | Occur | CE1 |
| 5 | AF + UB | 65.3 | 585 | 588 | 3 | 39 | Occur | CE2 |
| 6 | AF + PF | 1.2 | 521 | 543 | 22 | 65 | Occur | CE3 |
| 7 | AF + UB | 35.5 | 594 | 612 | 18 | 57 | Occur | CE4 |
| 8 | AF + PF | 0.2 | 521 | 488 | −33 | 99 | Not Occur | CE5 |
| 1 | AF + PF | 1.6 | 533 | 545 | 12 | 77 | Not Occur | CE6 |
| | AF + PF | 3.5 | 515 | 523 | 8 | 73 | Not Occur | CE7 |
| | AF + PF | 3.2 | 530 | 555 | 25 | 62 | Not Occur | CE8 |
| | AF + UB | 6.8 | 465 | 474 | 9 | 82 | Occur | CE9 |
| | PF + AF | 0.2 | 493 | 511 | 18 | 89 | Not Occur | CE10 |
| | PF + AF | 0.1 | 425 | 467 | 42 | 100 | Not Occur | CE11 |

IE: Inventive Example
CE: Comparative Example
AF: Acicular Ferrite,
PF: Polygonal Ferrite,
UB: Upper Bainite As illustrated in Tables 1 to 3, Inventive Examples 1 to 3 satisfy the steel component range and the manufacturing process conditions of the present disclosure. Yield strength is 500 MPa or more, a DWTT percent ductile fracture is 85% or more at a temperature of −20° C., and hydrogen-induced cracking resistance is excellent.

Meanwhile, in Comparative Examples 1 to 11 which are outside of any one of the steel composition components and the manufacturing process conditions of the present disclosure, yield strength for the steel is less than 500 MPa, or strength is reduced after 620° C. PWHT, and low-temperature DWTT characteristics or hydrogen-inducted cracking resistance is insufficient.

Accordingly, a steel plate is manufactured according to example embodiments of the present disclosure to obtain a thick steel material of a yield strength grade of 500 MPa, having excellent low-temperature DWTT characteristics and excellent hydrogen-induced cracking resistance and having a thickness of 300 mm or more and a width of 3,500 mm or more, and a steel plate in which a decrease in strength does not occur even after a post-heat treatment.

The invention claimed is:

1. A SOUR-resistant heavy-wall steel plate, the SOUR-resistant heavy-wall steel plate comprises:

in terms of weight %, 0.02-0.06% of C; 0.5% or less of Si (excluding 0%); 0.8-2.0% of Mn; 0.03% or less of P; 0.003% or less of S; 0.06% or less of Al; 0.01% or less of N; 0.005-0.1% of Nb; 0.005-0.05% of Ti; 0.0005-0.005% of Ca; one or more selected from 0.05-0.5% of Ni, 0.05-0.5% of Cr, 0.02-0.4% of Mo, and 0.005-0.1% of V; and the remainder Fe and unavoidable impurities, wherein the heavy-wall steel plate has a microstructure consisting of a complex structure of acicular ferrite and polygonal ferrite, and a fraction of upper bainite within 10 mm of upper and lower portions on a basis of a thickness central portion of the heavy-wall steel plate is 5 area or less, wherein the heavy-wall steel plate satisfies relational expressions 1-3, and has a percent ductile fracture of 85% or more in the drop weight tear test (DWTT) at −20° C., $$Ca/S: 0.5\sim5.0 \quad \text{[Relation Expression 1]}$$

$$Ni+Cr+Mo+V\leq0.8\% \quad \text{[Relational Expression 2]}$$

$$Nb-0.5*C+0.35*N>0\% \quad \text{[Relational Expression 3]}$$

where Ca, S, Ni, Cr, Mo, V, Nb, C, and N represent contents of respective elements by wt %.

2. The SOUR-resistant heavy-wall steel plate of claim 1, wherein the heavy-wall steel plate has a thickness of 30 mm or more, a width of 3500 mm or more, and yield strength of 500 MPa or more.

3. The SOUR-resistant heavy-wall steel plate of claim 1, wherein the yield strength of the heavy-wall steel plate is not decreased after Post Weld Heat Treatment (PWHT).

4. A method of manufacturing a SOUR-resistant heavy-wall steel plate having low-temperature toughness and hot-heat treatment characteristics, the method comprising:

rough rolling a steel slab including, in terms of weight %, 0.02-0.06% of C; 0.5% or less of Si (excluding 0%); 0.8-2.0% of Mn; 0.03% or less of P; 0.003% or less of S; 0.06% or less of Al;

0.01% or less of N; 0.005-0.1% of Nb; 0.005-0.05% of Ti; 0.0005-0.005% of Ca; one or more selected from 0.05-0.5% of Ni, 0.05-0.5% of Cr, 0.02-0.4% of Mo, and 0.005-0.1% of V; and the remainder Fe and unavoidable impurities, and satisfying relational expressions 1-3, after reheating the steel slab;

controlling maintaining time, until start of finish rolling after water-cooling the rough rolled steel slab, to be 300 seconds or less, and then finish rolling the steel slab at Ar3+200° C. to Ar3+30° C. at a cumulative reduction ratio of 50% or more; and starting to cool the finish rolled steel slab at Ar3+100° C. to Ar3 at a cooling rate of 15° C./sec and ending the cooling at 500° C. or less, wherein the heavy-wall steel plate, obtained by ending the cooling, has a microstructure consisting of a complex structure of acicular ferrite and polygonal ferrite, and a fraction of the upper bainite within 10 mm of upper and lower portions on the basis of a thickness central portion is 5 area % or less, [Relation Expression 1]

$$Ca/S: 0.5\sim5.0 \quad \text{[Relation Expression 1]}$$

$$Ni+Cr+Mo+V\leq0.8\% \quad \text{[Relational Expression 2]}$$

$$Nb-0.5*C+0.35*N>0\% \quad \text{[Relational Expression 3]}$$

where Ca, S, Ni, Cr, Mo, V, Nb, C, and N represent contents of respective elements by wt %.

5. The method of claim 4, wherein the heavy-wall steel plate, obtained by ending the cooling, a thickness of 30 mm or more, a width of 3500 mm or more, and yield strength of 500 MPa or more.

6. The method of claim 4, further comprising: performing a Post Weld Heat Treatment (PWHT) heat treatment on the heavy-wall steel plate obtained by ending the cooling.

7. The method of claim 6, wherein the yield strength of the heavy-wall steel plate is not decreased even after performing the PWHT heat treatment.

* * * * *